US008063795B2

(12) United States Patent
Ross et al.

(10) Patent No.: US 8,063,795 B2
(45) Date of Patent: Nov. 22, 2011

(54) PEDESTRIAN ACTIVATED STOP SIGN

(76) Inventors: David Ross, Westport, CT (US); William Lloyd, Westport, CT (US)

( * ) Notice: Subject to any disclaimer, the term of this patent is extended or adjusted under 35 U.S.C. 154(b) by 337 days.

(21) Appl. No.: 12/393,745

(22) Filed: Feb. 26, 2009

(65) Prior Publication Data

US 2010/0214127 A1 Aug. 26, 2010

(51) Int. Cl.
*G08G 1/07* (2006.01)

(52) U.S. Cl. ..... 340/925; 340/907; 340/908; 340/917; 340/944; 116/63 R

(58) Field of Classification Search ..... 340/907, 340/908, 909, 917, 918, 925, 945, 944; 116/63 R; 362/183; 40/541, 557
See application file for complete search history.

(56) References Cited

U.S. PATENT DOCUMENTS

| | | | | |
|---|---|---|---|---|
| 4,025,922 | A | | 5/1977 | Trawick, III |
| 5,755,051 | A | * | 5/1998 | Zumbuhl ..... 40/586 |
| 5,959,554 | A | | 9/1999 | Armstrong et al. |
| 6,052,067 | A | | 4/2000 | Nuxoll |
| 6,104,313 | A | | 8/2000 | Boyd, II |
| 6,147,623 | A | | 11/2000 | Rippen |
| 6,150,957 | A | | 11/2000 | Henz et al. |
| 6,198,410 | B1 | | 3/2001 | White et al. |
| 6,204,777 | B1 | | 3/2001 | Lyons |
| 6,384,742 | B1 | | 5/2002 | Harrison |
| 6,448,905 | B1 | | 9/2002 | Jones |
| 7,317,405 | B2 | | 1/2008 | Green et al. |
| 7,375,650 | B2 | | 5/2008 | Lo |
| 2002/0104242 | A1 | | 8/2002 | Haugen |

OTHER PUBLICATIONS

The Effects of Innovative Pedestrian Signs at Unsignalized Locations: A Tale of Three Treatments, U.S. Department of Transportation, Aug. 2000, Report No. FHWA-RD-00-098.
What to do at Special Crosswalks: A Guide for Drivers and Pedestrians, City of Richmond Transportation Department.
Crosswalk Lessons for Cole Near Ustick: Article taken from Boise Guardian, Aug. 5, 2008.

* cited by examiner

*Primary Examiner* — Anh V La
(74) *Attorney, Agent, or Firm* — Amster Rothstein & Ebenstein LLP

(57) ABSTRACT

An embodiment of the present invention is an illuminated stop sign for allowing pedestrians to control traffic. The system comprises a fixed support assembly; a pedestrian activated mechanism; a timer set for a predetermined period of time when the pedestrian activated mechanism is activated; and an octagonal display nonremovably mounted to the fixed support assembly comprising a backlight within the display and a display surface comprising a word "STOP" visible when the backlight is illuminated and substantially not visible when the backlight is not illuminated, the backlight being illuminated until the predetermined period of time is expired.

20 Claims, 9 Drawing Sheets

PEDESTRIAN ACTIVATED STOP SIGN

FIELD OF INVENTION

The present invention relates to pedestrian activated stop signs, which when activated by a pedestrian become operational stop signs, but when not activated will not operate as a stop sign.

SUMMARY OF THE INVENTION

According to an embodiment of the present invention, an illuminated stop sign is provided for allowing pedestrians to control traffic. The pedestrian activated stop sign comprises a fixed support assembly; a pedestrian activated mechanism; a timer set for a predetermined period of time when the pedestrian activated mechanism is activated; and an octagonal display nonremovably mounted to the fixed support assembly comprising a backlight within the display and a display surface comprising a word "STOP" visible when the backlight is illuminated and substantially not visible when the backlight is not illuminated, the backlight being illuminated until the predetermined period of time is expired.

In at least one embodiment, the fixed support assembly may be a pole.

In at least one embodiment, the pedestrian activated mechanism may be a switch.

In at least one embodiment, the pedestrian activated mechanism may be a button.

In at least one embodiment, the timer may be a mechanical timer.

In at least one embodiment, the timer may be an electronic timer.

In at least one embodiment, the timer may be capable of activating the backlight based on an electronic signal.

In at least one embodiment, the display surface may comprise a flashing image with the word "STOP".

In at least one embodiment, the octagonal display may be mounted at a height of 4 to 6 feet from the ground.

In at least one embodiment, the octagonal display may be mounted at a height of approximately 5 feet from the ground.

In at least one embodiment, the timer is programmable.

In at least one embodiment, the display surface may be red when the backlight is illuminated.

In at least one embodiment, one or more warning lights may be positioned outside the periphery of the octagonal display.

In at least one embodiment, the warning lights may be capable of flashing when the pedestrian activated mechanism is activated.

According to an embodiment of the present invention, a system is provided for allowing a pedestrian to control traffic. The system comprises one or more fixed support assemblies; one or more pedestrian activated mechanisms; one or more timers set for a predetermined period of time when one or more said pedestrian activated mechanisms are activated; a communications link interconnecting said timers; and one or more octagonal displays nonremovably mounted to the fixed support assemblies comprising a backlight within each display and a display surface comprising a word "STOP" visible when the backlight is illuminated and substantially not visible when the backlight is not illuminated, the backlights being illuminated until the predetermined period of time is expired.

In at least one embodiment, the communications link may be hardwired.

In at least one embodiment, the communications link may further comprise a wireless transceiver.

In at least one embodiment, one or more warning lights may be positioned outside the periphery of the one or more octagonal displays.

In at least one embodiment, the warning lights may be capable of flashing when one or more of the pedestrian activated mechanisms are activated.

According to an embodiment of the present invention, a method of controlling traffic is provided. The method comprises the steps of: a) providing at least one pedestrian activated stop sign, each pedestrian activated stop sign comprising: (i) an octagonal display comprising a backlight and a display surface, wherein each display surface further comprises a word "STOP" visible when the backlight is illuminated substantially not visible when the backlight is not illuminated, (ii) a pedestrian activated mechanism, and (iii) a timer, and (b) activating the pedestrian activated mechanism, (c) activating the timer for a predetermined period of time in response to the pedestrian activated mechanism being activated, (d) illuminating the backlight for a predetermined period of time to display the word "STOP" in response to the pedestrian activated mechanism being activated, and (e) at the end of the predetermined period of time, turning off the backlight so that the word "STOP" is substantially not visible.

BRIEF DESCRIPTION OF THE DRAWINGS

The above and related objects, features and advantages of the present invention will be more fully understood by reference to the following, detailed description of an embodiment of the present invention when taken in conjunction with the accompanying figures, wherein.

DETAILED DESCRIPTION OF THE PRESENT INVENTION

The following is a description of various exemplary embodiments of the present invention. The intention is not to narrowly limit the present invention to the exact specifics described herein but to cover devices and methods that lie within the spirit and scope of the invention.

Conventional traffic control systems for crosswalks use either a permanent stop sign or a traffic light. A problem associated with such traditional traffic control systems is that when there is no pedestrian traffic, such systems can unnecessarily interfere with the flow of traffic. There has been a long felt need for a traffic control device which has a stop sign available when pedestrian traffic requires it, but not display a stop signal when there is no pedestrian traffic.

The present invention relates to a stop sign which can be activated by pedestrians to control traffic when desired, but allows the stop sign to remain inactive during periods where pedestrian traffic does not require its use. By allowing pedestrians to activate an illuminated stop sign only when necessary, the present invention increases pedestrian safety by prompting vehicular traffic to stop at a pedestrian crosswalk. It also eliminates the need for permanent non-illuminated stop signs or traffic lights, which needlessly interfere with the flow of traffic when there is no pedestrian activity. This may be further advantageous, not only to pedestrians, but also to drivers who will only be called upon to slow and stop when a pedestrian activates the device. In various exemplary embodiments, the system according to the present invention may accomplish these objectives by using at least one pedestrian activated mechanism, a timer, and at least one hexagonal display for controlling traffic.

Various exemplary embodiments of the present invention are hereto described with references to the Figures. These embodiments are meant to be merely illustrative and not limiting of the present invention.

Figure 1A:
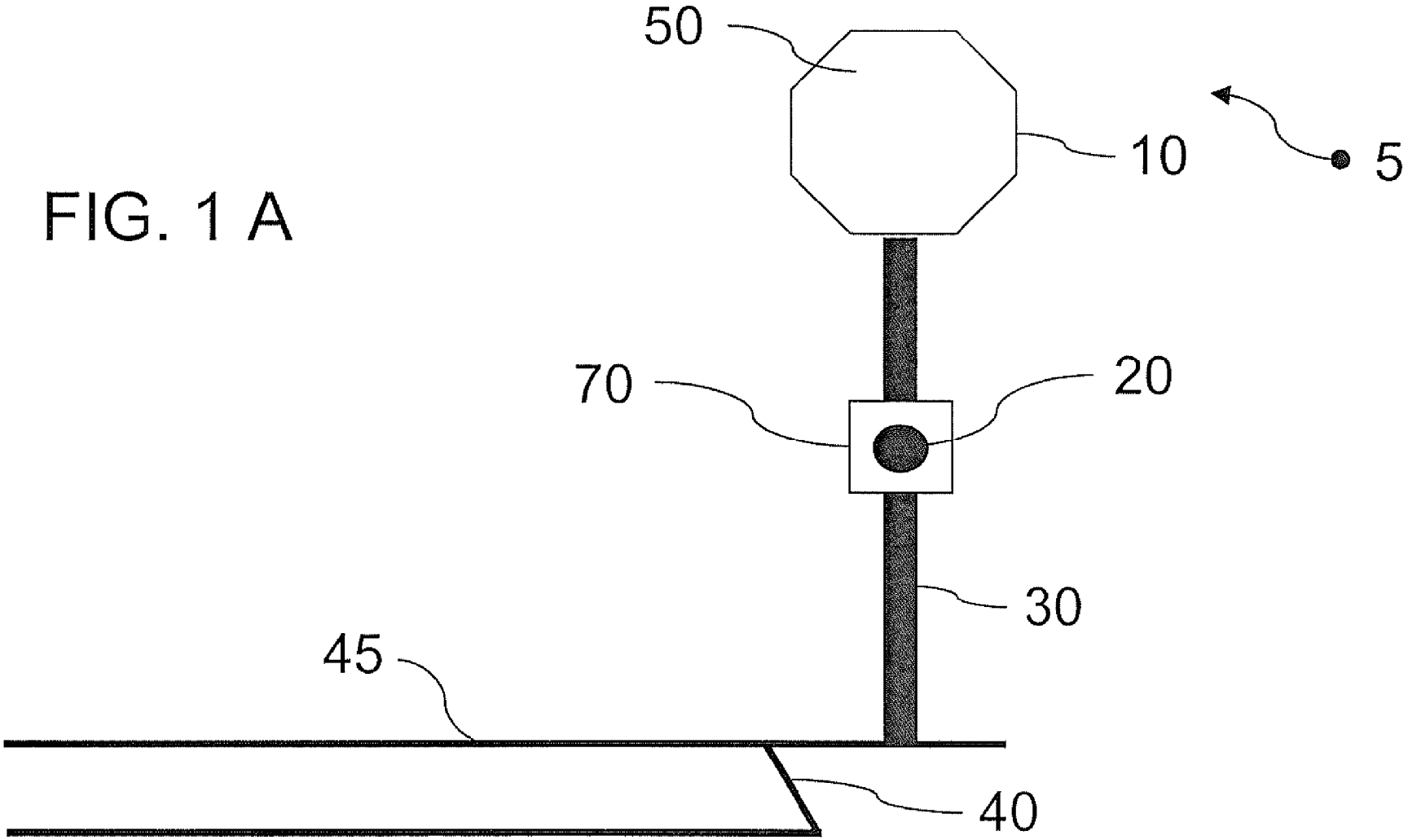
FIG. 1A is a front schematic view of the pedestrian activated stop sign in accordance with an embodiment of the present invention where the pedestrian activated mechanism, timer and backlight are not activated.
Figure 1B:
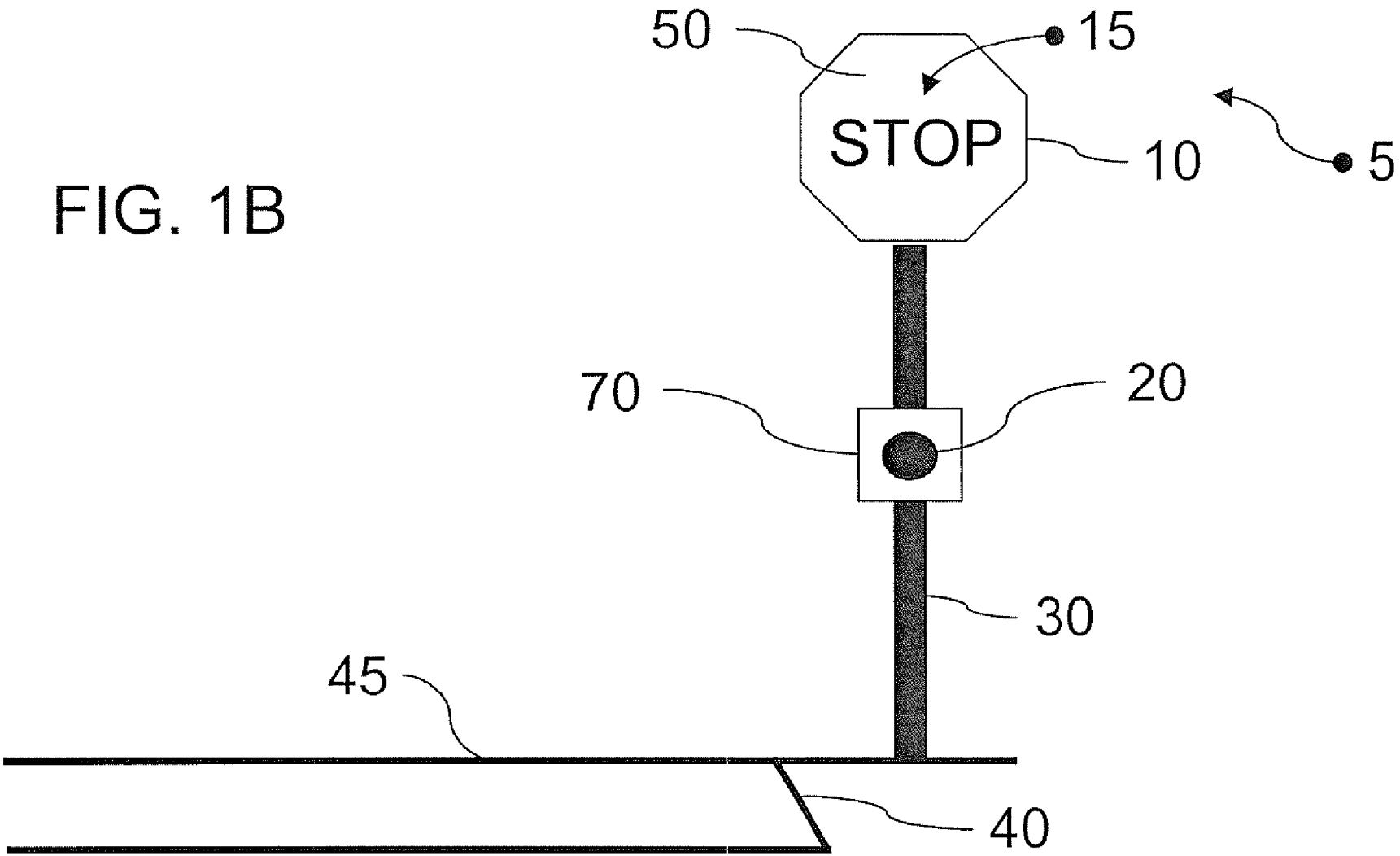
FIG. 1B is a front schematic view of the pedestrian activated stop sign in accordance with an embodiment of the present invention where the pedestrian activated mechanism, timer and backlight are activated.

FIGS. 1A and 1B illustrate a pedestrian activated stop sign, generally designated by reference number 5, in accordance with an exemplary embodiment of the present invention. FIG. 1A illustrates the pedestrian activated stop sign 5 in the inactive mode. FIG. 1B illustrates the pedestrian activated stop sign 5 in the activated mode. As illustrated in FIGS. 1A and 1B, the pedestrian activated stop sign 5 comprises a hexagonal display 10 having a display surface 50. When the stop sign 5 is in the active mode as shown in FIG. 1B, the display surface 50 is illuminated red and displays the word "STOP" 15 as an indication for oncoming vehicular traffic to stop. When the stop sign 5 is in an inactive mode, as shown in FIG. 1A, the display surface 50 does is not illuminated red and does not display the word "STOP" 15. Thus, in the inactive mode, vehicular traffic will not be affected by the stop sign 5.

The hexagonal display 10 may be mounted on a support pole 30. In one embodiment the hexagonal display 10 will be mounted between 4 to 6 feet from the ground 45 adjacent the cross-walk 40. In FIGS. 1A and 1B, the ground 45 and cross-walk 40 are shown at different elevations, however it is consistent with the letter and spirit of the present invention that the ground and cross walk could be at the same elevation. In an embodiment of the present invention, it is desired that the hexagonal display 10 be high enough from the ground 45 to be seen by oncoming traffic and not be otherwise obstructed.

The pedestrian activated stop sign 5 further comprises a pedestrian activated mechanism 20, such as a button, which can be activated by a pedestrian desiring to use the crosswalk 40 at appropriate times. The pedestrian activated mechanism 20 may be any suitable mechanism, such as, for example, a button, a switch or a sensor. The pedestrian activated mechanism 20 may be mechanical, electrical or electromechanical.

Figure 3:
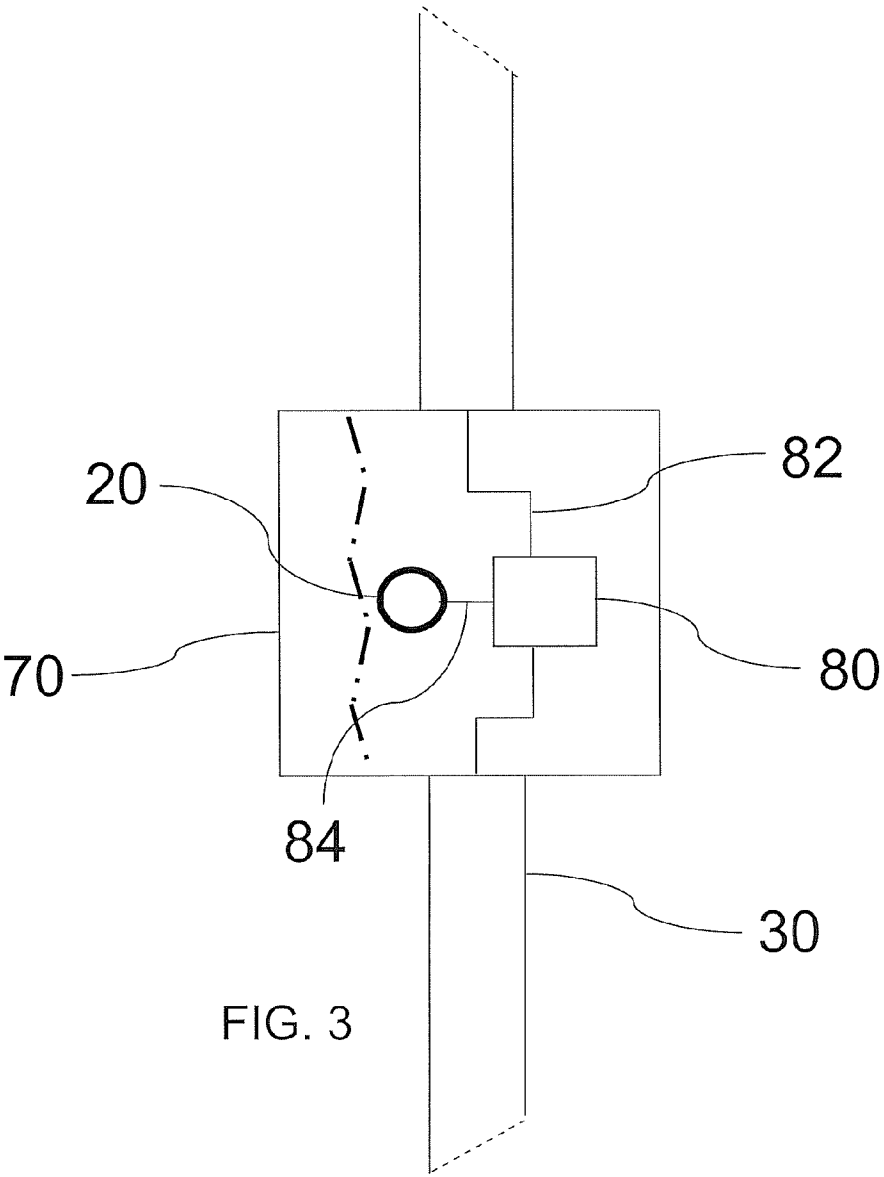
FIG. 3 is a front cutaway view of the housing for the pedestrian activated mechanism shown in FIGS. 1A, 1B and 2, depicting the pedestrian activated mechanism and timer.
Figure 4:
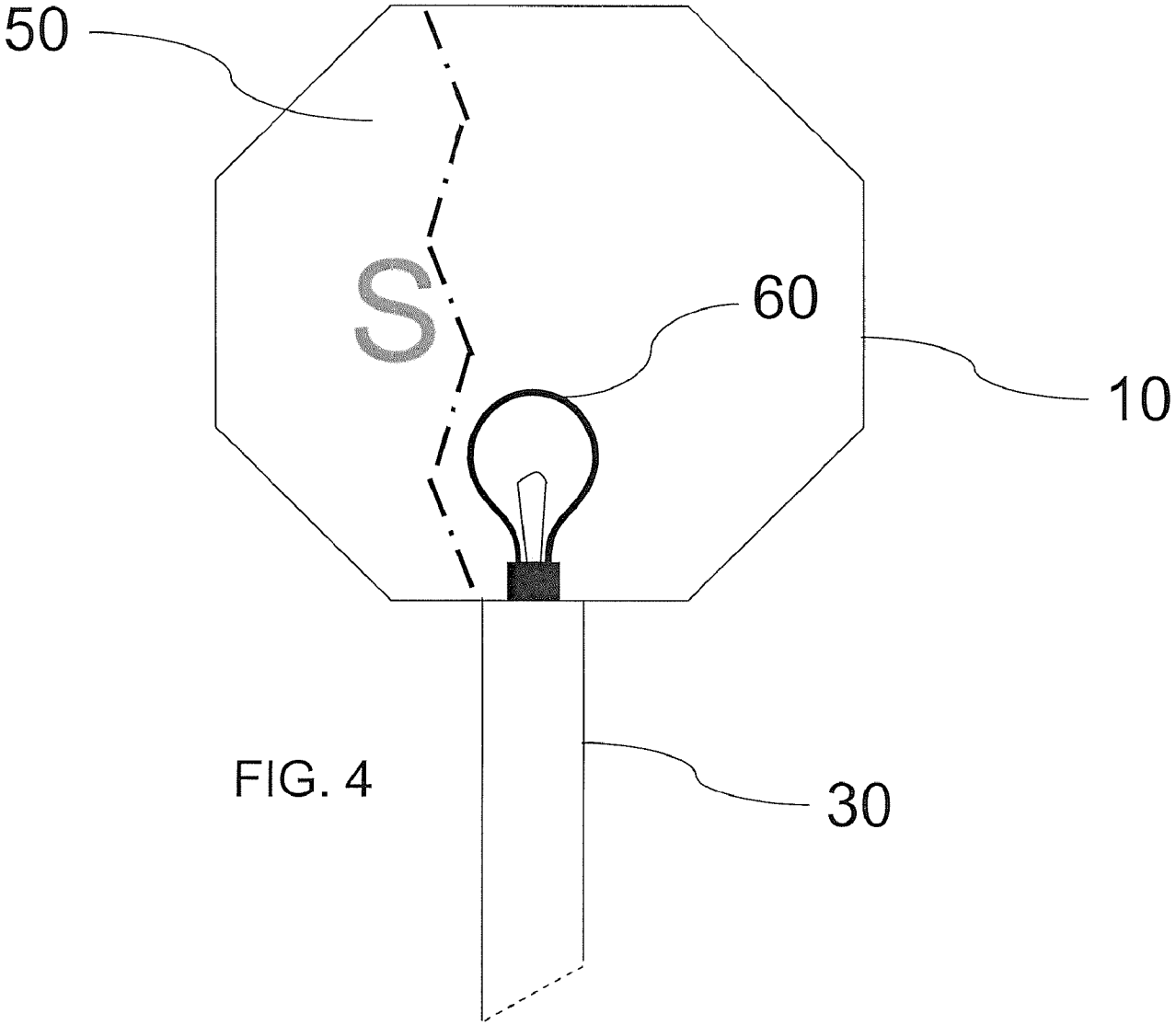
FIG. 4 is a front cutaway view of the hexagonal display shown in FIGS. 1A and 1B in accordance with an embodiment of the present invention depicting the display surface and backlight.

When a pedestrian activates the pedestrian activated mechanism 20, a timer 80 (FIG. 3) and a backlight 60 are activated. While backlight 60 is shown in FIG. 4 as a single incandescent light bulb, this is merely intended to illustrate how the backlight 60 may be used in conjunction with the present invention. It is understood that in applying the present invention more than one incandescent light bulb may be used, as well as various other types of backlights may be used, such as fluorescent, halogen, or high-intensity discharge lamps as well as light emitting diodes (LEDs), to name a few. As a result, the word "STOP" 15 becomes visible on the display surface 50. The timer 80 remains activated for a predetermined period of time. For example, the predetermined period of time may be based upon the total crossing distance divided by the average pedestrian walking speed (e.g., 2 to 3 MPH). Additional time may be added to account for slower pedestrians. The time may also be adjustable so the same stop sign 5 may be available for use in more than one intersection.

In an exemplary embodiment, if the pedestrian activated mechanism 20 is activated by a second pedestrian while the timer 80 is activated, the timer 80 may remain activated for a second predetermined period of time. The second predetermined period of time may be based upon the same type of considerations as the first predetermined period of time. Alternatively, the timer 80 may be programmed not to be activated until after the first predetermined period of time has expired, to allow the traffic an opportunity to flow. When the first and/or second predetermined period of time elapses, the backlight 60 is deactivated and the word "STOP" 15 is substantially not visible on the display surface 50. As an additional alternative, the timer 80 may be programmed to activate for a shortened amount of time. When the first predetermined period of time has expired, the timer 80 will remain active for a second period of time which is shorter that the first predetermined period of time.

Figure 2:
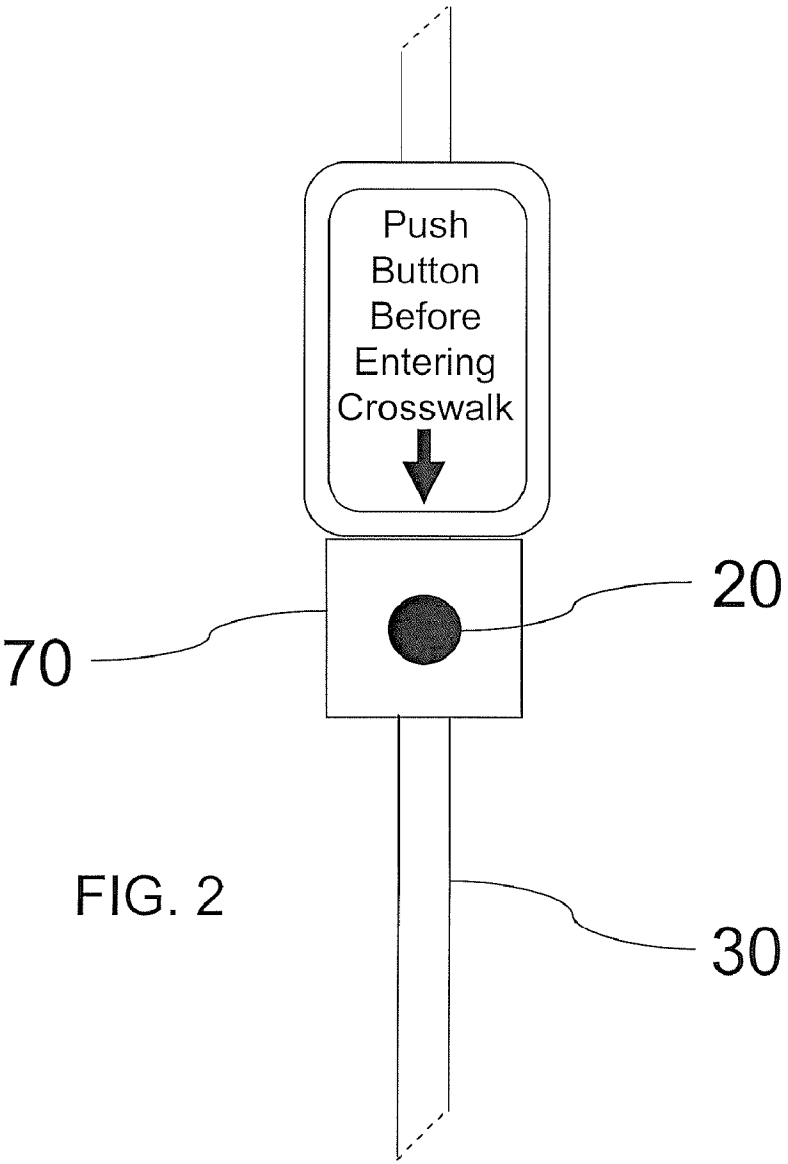
FIG. 2 is a front schematic view of the pedestrian activated mechanism shown in FIG. 1A and FIG. 1B.

A housing 70 may be provided on the pole 30 for the pedestrian activated mechanism 20. As shown in FIGS. 2 and 3, the housing 70 may also enclose the timer 80. Wires 82 and 84 are shown connecting the pedestrian activated mechanism 20 to the timer 80 and backlight 60. Other components that may be used to implement the present invention are not shown in the Figures. Alternatively, the timer 80 may be enclosed in the hexagonal display 10, in the support pole 30 or other convenient location.

In operation, the pedestrian activated stop sign 5 may be used to allow pedestrians to control traffic at otherwise unprotected crosswalks through the use of a pedestrian activated mechanism 20. The pedestrian activated mechanism 20 activates the timer 80 and backlight 60 for a predetermined period of time. As a result, the word "STOP" 15 is visible on the display surface 50, prompting vehicle traffic to stop at the crosswalk 40. Since the display surface 50 is illuminated, the present invention is far more visible than permanent non-illuminated stop signs. In addition, since the word "STOP" 15 is only visible on the display surface 50 when the device is activated by a pedestrian, vehicles are not required to decelerate and stop when there are no pedestrians in the crosswalk. The present invention increases pedestrian safety, improves the flow of traffic and eliminates the wasteful idling of vehicles.

FIG. 2 represents another view of the embodiment shown in FIG. 1A and FIG 1B. In particular, FIG. 2 is a schematic view of the pedestrian activation mechanism 20. As the pedestrian approaches the crosswalk 40 they are directed to the pedestrian activation mechanism 20 which in this embodiment is a push-button switch contained within a housing 70 mounted on a support pole 30. When the pedestrian depresses the push-button switch 20 the timer 80 is activated for the predetermined period of time.

FIG. 3 represents another view of the embodiment shown in FIGS. 1A, 1B and 2. In particular, FIG. 3 is a cutaway view of the housing 70 for the pedestrian activated mechanism 20. As can be seen, the pedestrian activated mechanism 20 is connected to timer 80 by wire 84. In addition, timer 80 is connected to backlight 60 (shown in FIG. 4) by wire 82.

FIG. 4 represents another view of the embodiment shown in FIGS. 1A, 1B and 2-3. In particular, FIG. 4 is a cutaway view of the hexagonal display 10. As can be seen, the backlight 60 is disposed within the display and positioned, so when activated, the display surface 50 appears red and the word "STOP" 15 is visible on the display surface 50.

Figure 5:
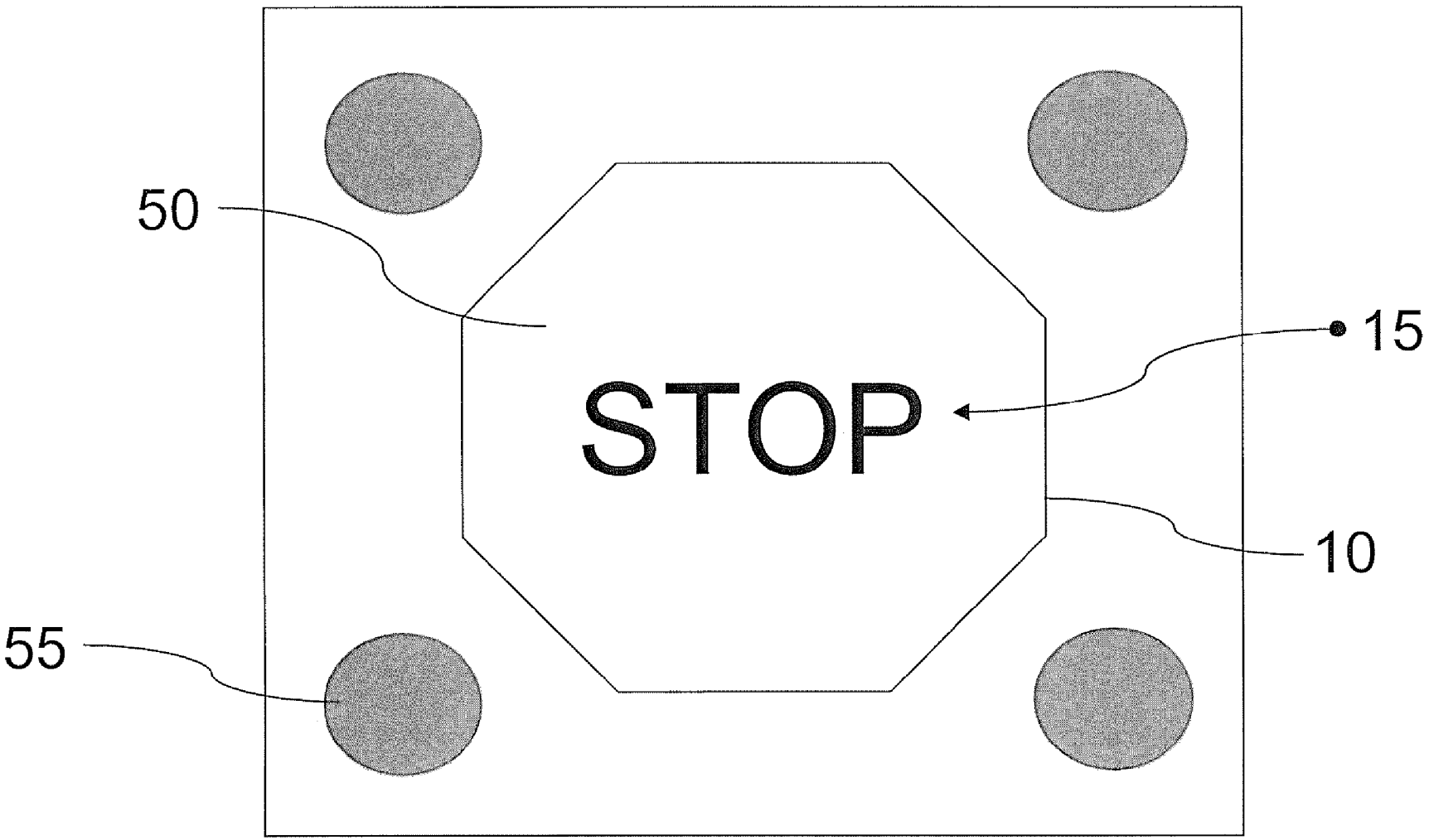
FIG. 5 is front schematic view of an embodiment of the pedestrian activated stop utilizing additional warning lights.

FIG. 5 represents a exemplary embodiment of the present invention in which one or more warning lights 55 have been position outside the periphery of the hexagonal display 10. As shown in this example, four circular warning lights 55 are positioned about the hexagonal display 10 in order to further enhance the visibility of the pedestrian activated stop sign 5 to motorists. These warning lights 55 may be configured to flash, for example, a red warning signal when the word "STOP" 15 is visible on the display surface 50.

Figure 6:
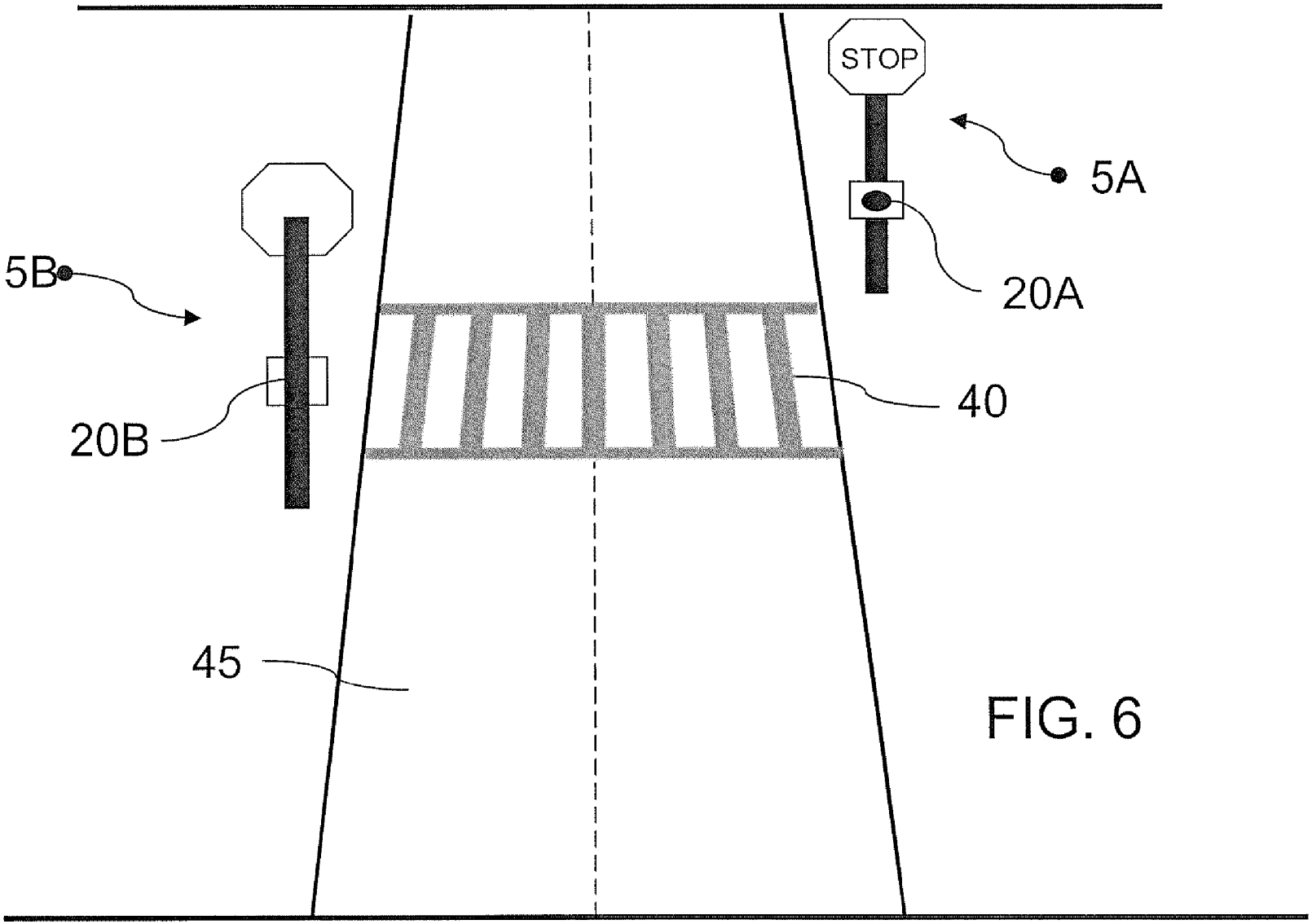
FIG. 6 is a pictorial view of an embodiment of the pedestrian activated stop sign where more than one stop sign is utilized to control traffic on a bi-directional street.

FIG. 6 represents an exemplary embodiment of the present invention in which a first stop sign 5A and a second stop sign 5B are utilized to allow pedestrians to control traffic on a two-way street. As show in the Figure, one stop sign 5A is positioned to alert vehicles travelling in one direction while a second stop sign 5B is positioned to alert vehicles travelling in a second direction. A pedestrian approaching the crosswalk 40 may activate the first pedestrian activated mechanism 20A or the second pedestrian activated mechanism 20B. Since the two stop signs, 5A and 5B, are connected by a communications link (not shown) both stop signs will be activated for the same predetermined period of time. During this time vehicle traffic will be stopped in both directions of travel, allowing the pedestrian to safely traverse the street by way of the crosswalk 40. The communications link between the two stop signs may consist of a hardwired communications system placed underneath the roadway 45 or run overhead. Alternatively, a wireless system may be utilized, consisting of multiple wireless transceivers.

Figure 7:
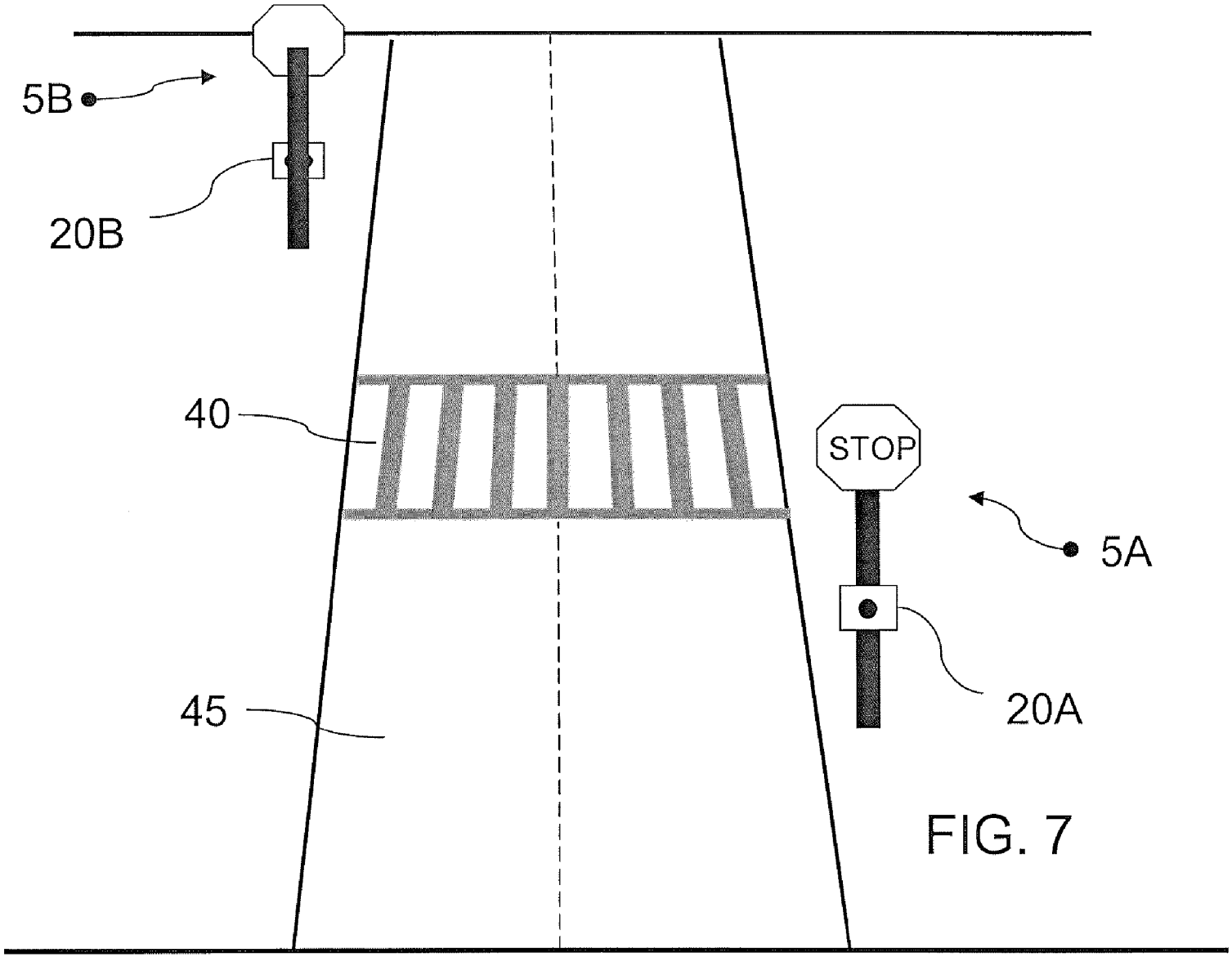
FIG. 7 is a pictorial view of an embodiment of the pedestrian activated stop sign where more than one stop sign is utilized to control traffic on a bi-directional street.

FIG. 7 represents a second exemplary embodiment of the present invention in which a first stop sign 5A and a second stop sign 5B are utilized to allow pedestrians to control traffic on a two-way street. As explained above, a pedestrian approaching the crosswalk 40 may activate the first pedestrian activated mechanism 20A or the second pedestrian activated mechanism 20B. Since the two stop signs, 5A and 5B, are connected by a communications link (not shown) both stop signs will be activated for the same predetermined period of time. As shown in the Figure, each stop sign, 5A and 5B, is positioned, for example, approximately ten feet in front of the crosswalk 40 relative to the direction of vehicular travel. As a result, motorists approaching the activated stop signs, 5A and 5B, will be required to stop at a greater distance from the crosswalk 40, further increasing pedestrian safety.

Figure 8:
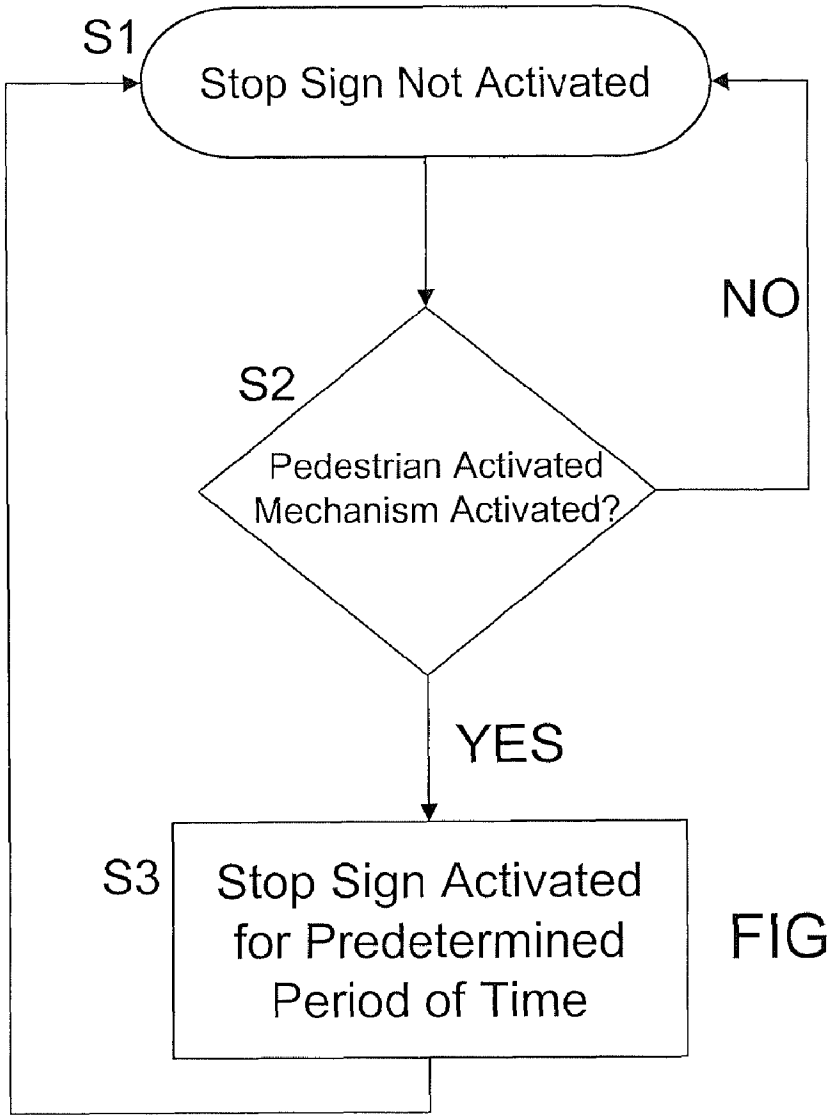
FIG. 8 is a flowchart depicting the control logic of the stop sign in accordance with an embodiment of the present invention.

FIG. 8 is a flowchart illustrating a method of operation of a pedestrian activated stop sign according to an embodiment of the present invention. In step S1, the stop sign is in the inactive state, and process flows to step S2 where it is determined whether the pedestrian activated mechanism has been activated. If the answer is NO the stop sign remains in an inactive state at S1. If the answer is YES, the stop sign transitions to an activated state at step S3 for the predetermined period of time. Once the predetermined period of time has expired the stop sign returns to the inactive state at S1.

Crosswalks may be marked or unmarked. A marked crosswalk is typically outlined by painted markings. Crosswalks are usually marked at intersections where there is a high volume of pedestrian and vehicle traffic, such as four way intersections. Typically, these crosswalks are controlled by automated traffic lights and indicators directing the flow of vehicular and pedestrian traffic. Sometimes crosswalks are marked at mid-block locations to accommodate pedestrian traffic. Permanent, non-illuminated, stop signs frequently accompany the painted lines at these locations. Regardless of whether an automated traffic control system or a non-illuminated stop sign is utilized, vehicle traffic is forced to yield and stop even when no pedestrians are present in the crosswalk. As shown in the Figures described above, the present invention does not unnecessarily impede the flow of traffic in such a manner.

In each embodiment, the pedestrian activated stop sign may be supplied with operating power by the municipality through underground or overhead conductors. Alternatively, solar powered mechanisms utilizing one or more solar panels and one or more storage batteries may be incorporated.

Now that various embodiments of the present invention have been shown and described in detail, various modifications and improvements thereon will become readily apparent to those skilled in the art. The present embodiments are therefore to be considered in all respects as illustrative and not restrictive, the scope of the invention being indicated by the appended claims, and all changes that come within the meaning and range of equivalency of the claims are therefore intended to be embraced therein.

What is claimed:

1. A pedestrian activated stop sign, comprising:

a fixed support assembly;

a pedestrian activated mechanism;

a timer set for a predetermined period of time when the pedestrian activated mechanism is activated; and an octagonal display nonremovably mounted to the fixed support assembly comprising a backlight within the display and a display surface comprising a word "STOP" visible when the backlight behind the display surface is illuminated and substantially not visible when the backlight is not illuminated, the backlight being illuminated until the predetermined period of time is expired.

2. The pedestrian activated stop sign of claim 1, wherein the fixed support assembly is a pole.

3. The pedestrian activated stop sign of claim 1, wherein the pedestrian activated mechanism is a switch.

4. The pedestrian activated stop sign of claim 1, wherein the pedestrian activated mechanism is a button.

5. The pedestrian activated stop sign of claim 1, wherein the timer is a mechanical timer.

6. The pedestrian activated stop sign of claim 1, wherein the timer is an electronic timer.

7. The pedestrian activated stop sign of claim 1, wherein the timer is capable of activating the backlight based on an electronic signal.

8. The pedestrian activated stop sign of claim 1, wherein the display surface comprises a flashing image with the word "STOP".

9. The pedestrian activated stop sign of claim 1, wherein the octagonal display is mounted at a height of 4 to 6 feet from the ground.

10. The pedestrian activated stop sign of claim 1, wherein the octagonal display is mounted at a height of approximately 5 feet off the ground.

11. The pedestrian activated stop sign of claim 1, wherein the timer is programmable.

12. The pedestrian activated stop sign of claim 1, wherein the display surface is the red when the backlight is illuminated.

13. The pedestrian activated stop sign of claim 1 further comprising one or more warning lights positioned outside the periphery of the octagonal display.

14. The pedestrian activated stop sign of claim 13, wherein the warning lights are capable of flashing when the pedestrian activated mechanism is activated.

15. A system for allowing a pedestrian to control traffic, comprising:

one or more fixed support assemblies;

one or more pedestrian activated mechanisms;

one or more timers set for a predetermined period of time when one or more said pedestrian activated mechanisms are activated;

a communications link interconnecting said timers; and one or more octagonal displays nonremovably mounted to the fixed support assemblies comprising a backlight within each display and a display surface comprising a word "STOP" visible when the backlight behind the display surface is illuminated and substantially not visible when the backlight is not illuminated, the backlights being illuminated until the predetermined period of time is expired.

16. The system of claim 15, wherein the communications link is hardwired.

17. The system of claim 15, wherein the communications link further comprises a wireless transceiver.

18. The system of claim 15 further comprising one or more warning lights positioned outside the periphery of the one or more octagonal displays.

19. The of claim 18, wherein the warning lights are capable of flashing when one or more of the pedestrian activated mechanisms are activated.

20. A method of controlling traffic comprising the steps of:

(a) providing at least one pedestrian activated stop sign, each pedestrian activated stop sign comprising:

(i) an octagonal display comprising a backlight and a display surface, wherein each display surface further comprises a word "STOP" visible when the backlight behind the respective display surface is illuminated substantially not visible when the backlight is not illuminated, (ii) a pedestrian activated mechanism, and (iii) a timer, and (b) activating the pedestrian activated mechanism, (c) activating the timer for a predetermined period of time in response to the pedestrian activated mechanism being activated, (d) illuminating the backlight for a predetermined period of time to display the word "STOP" in response to the pedestrian activated mechanism being activated, and (e) at the end of the predetermined period of time, turning off the backlight so that the word "STOP" is substantially not visible.

* * * * *